United States Patent [19]

Westerman

[11] 4,389,114

[45] Jun. 21, 1983

[54] ROLL FIXING APPARATUS FOR A COPYING MACHINE

[75] Inventor: Theodore N. Westerman, Easton, Conn.

[73] Assignee: Pitney Bowes Inc., Stamford, Conn.

[21] Appl. No.: 342,562

[22] Filed: Jan. 25, 1982

[51] Int. Cl.[3] ..... G03G 15/00; G03G 15/20

[52] U.S. Cl. ..... 355/3 FU; 355/3 SH; 355/14 FU; 118/DIG. 15; 430/98; 219/216

[58] Field of Search ..... 355/14 SH, 14 FU, 3 SH, 355/3 FU; 271/109, 63; 308/15, 31, 33, 120 R, 245, 202, 203; 118/661, DIG. 15; 219/216; 430/97, 98

[56] References Cited

U.S. PATENT DOCUMENTS

| | | | |
|---|---|---|---|
| 4,188,109 | 2/1980 | Idenawa et al. | 355/3 FU |
| 4,200,389 | 4/1980 | Matsui et al. | 355/3 FU |
| 4,272,666 | 6/1981 | Collin | 355/3 FU X |
| 4,290,691 | 9/1981 | Giorgini | 355/3 FU |
| 4,341,458 | 7/1982 | Glasa et al. | 355/3 FU |
| 4,357,094 | 11/1982 | Zepko | 355/3 FU |

*Primary Examiner*—A. C. Prescott

*Attorney, Agent, or Firm*—Martin D. Wittstein; William D. Soltow, Jr.; Albert W. Scribner

[57] ABSTRACT

An electrophotographic copying machine has a device for fixing toner. The fixing device is constructed such that it has a base support with two pairs of locating holes for a pair of spaced apart lower end blocks having means to support bearings which rotatably support the lower fixing roller. There is an upper pressure roller which rests upon the lower roller. The upper roller is rotatably supported by bearings which are clamped downwards through engagement with "U" Bolts. In turn, the "U" Bolts are yieldably attached through the locating holes to the base support of the fixing unit. The "U" Bolts are threaded at the respective straight shanks, which allows for easy adjustment of the roller nip pressure through springs and adjusting nuts, engaged to the shanks of the "U" Bolts beneath the base support.

5 Claims, 6 Drawing Figures

FIG. 5
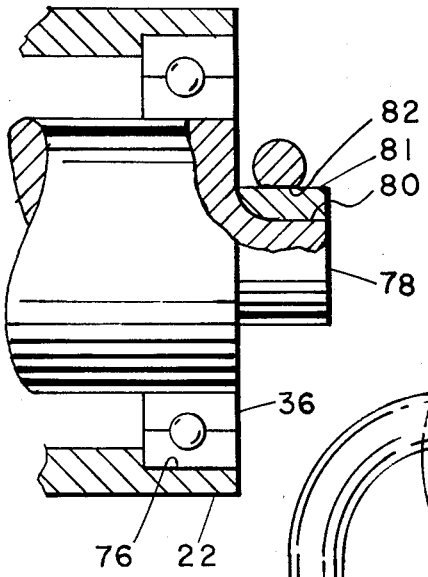
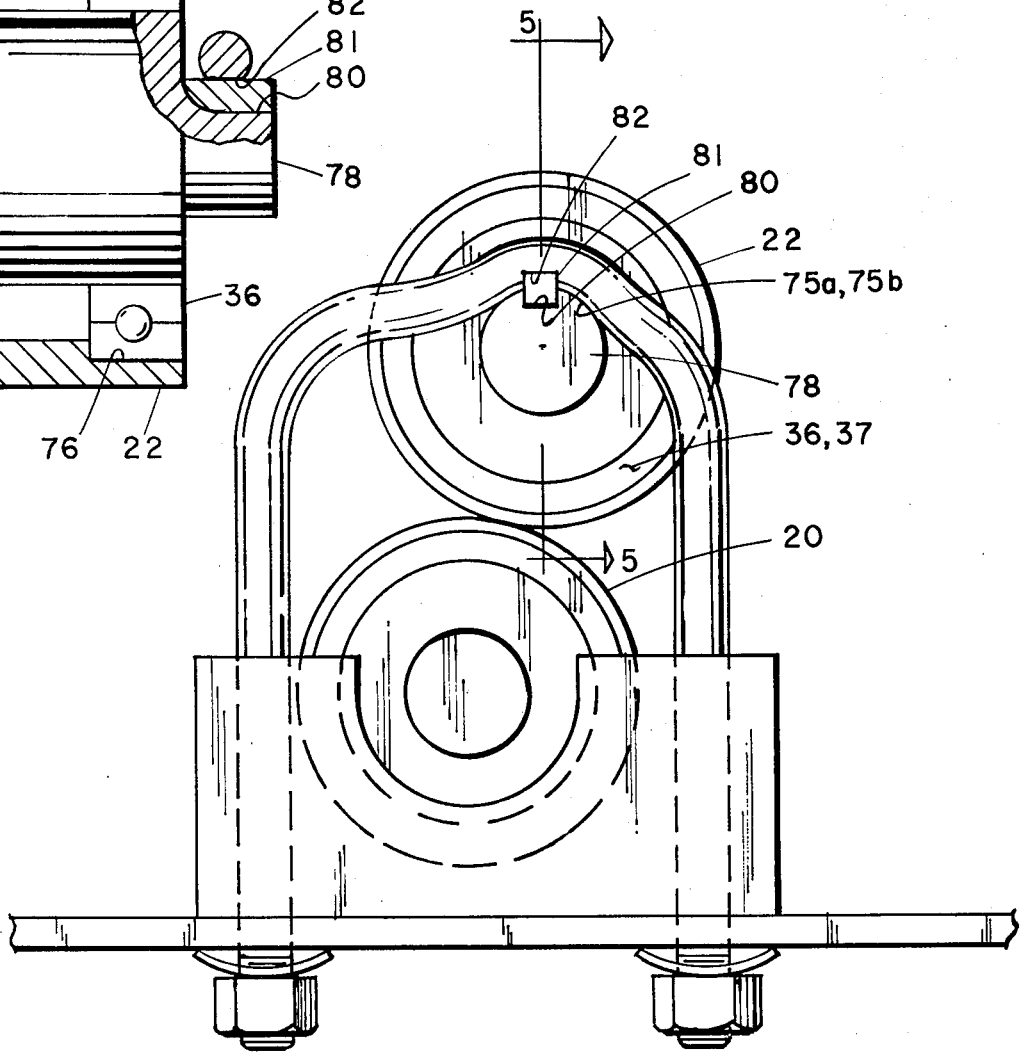
FIG. 4

ROLL FIXING APPARATUS FOR A COPYING MACHINE

BACKGROUND OF THE INVENTION

The present invention relates to a fixing device utilized within an electrographic copying machine.

Typically, copying machines have a fixing unit, which is comprised of fixing rollers with either heated or cold pressure capability for permatizing the copy image. The rollers are applied together in a pair, having a particular degree of unit pressure at their nip. The pressure often depends on the type of copy paper utilized within the copying process of the copier.

Some fixing rollers are intentionally loaded together with relatively light pressure, such as 10 pounds per lineal inch. This is especially true of hot fusing devices, with internally heated rollers having silicone elastomer coatings on their exterior surfaces. Other fixing devices have rollers which are loaded together with pressure of substantial magnitude. The higher pressure capability fixing devices have rollers which are typically made from highly polished and hardened steels which are capable of withstanding loading of about 300 pounds per lineal inch.

And, the type of copy paper utilized in the copier, effects what degree of pressure is utilized within the fixing unit. For example, types of coated paper which receives the image directly such as zinc oxide, requires a lesser degree of pressure than bond paper. The bond paper typically requires the higher 300 pounds per inch loading.

In any case, it is important to recognize that it is desirable to keep the unit pressure loading between the fixing rollers at as low a magnitude as possible without sacrificing finished copy quality. A substantial pressure such as 300 pounds per inch magnitude obviously requires increased machine power to drive the rolls. And as demonstrated by prior art, creates a fixing unit assembly which is more difficult to construct because of the extra end to end loading required to bend the crossed rollers about each other, and the extra parts required to support and sustain the required loads.

As previously mentioned, the prior art discusses the means and the need to gain uniformly distributed lineal pressure across the full span of the fixing rollers.

PRIOR ART

In U.S. Pat. No. 4,145,965, issued to KiKuchi et al, a fixing unit is disclosed which includes a pair of metal rollers which are loaded to a predetermined pressure. This is accomplished by physically crossing at least one roller with respect to the other.

The arrangement is very similar in construction to a nutcracker in respect to how the ends of the rollers are held in framework. There is included a lever arm system for holding the ends of the rollers, which enable including means for applying pressure through use of mechanical advantage. The lever arm system has compression springs designed to bear simultaneously on the lever arms and the ground framework of the fixing unit in order to provide the required pressure.

U.S. Pat. No. 4,022,122 discloses a pressing arrangement which includes a pair of opposed pressure rollers mounted on shafts which are mutually crossed at their respective midspan. The bearing blocks are pivotally connected with respect to each other by a leaf spring joint arrangement at each lateral end of the unit. These springs provide the flexure capability necessary for copy paper to enter and pass through the fixing unit.

SUMMARY OF THE INVENTION

A device for fixing toner images unto copy paper within an electrophotographic copying machine is constructed with a base support, and a pair of spaced apart lower end blocks having bearings for rotatably supporting the lower fixing roller. There is an upper pressure roller resting on the lower roller, and bearings provided for rotatably supporting and locating the upper roller. A clamping device in the form of a "U" Bolt is provided to engage the upper roller bearings in order to press the upper rollers resiliently against the lower roller through force exerted by springs provided at the device base support, where the springs press against the support and adjustable clamp nuts.

It is an object of the present invention to provide a simplified method of construction of a fixing apparatus with crossed axis rollers. This is accomplished through implementation of clamp members in the form of "U" bolts, a support with locating holes, wavy springs and adjustable pressure nuts.

This arrangement provides the basis for simplified construction of a fixing apparatus through simplified location and retention of parts including the rolls and easy access and adjustment of the roller nip pressure.

DESCRIPTION OF THE DRAWINGS

FIG. 4 is an end view of another embodiment of the apparatus shown in FIG. 1 with a modification of the clamp "U" Bolt design.

FIG. 5 is a partial section view taken from FIG. 4, showing the means of holding the upper roller shaft and bearings.

DETAILED DESCRIPTION OF THE INVENTION

Figure 1:
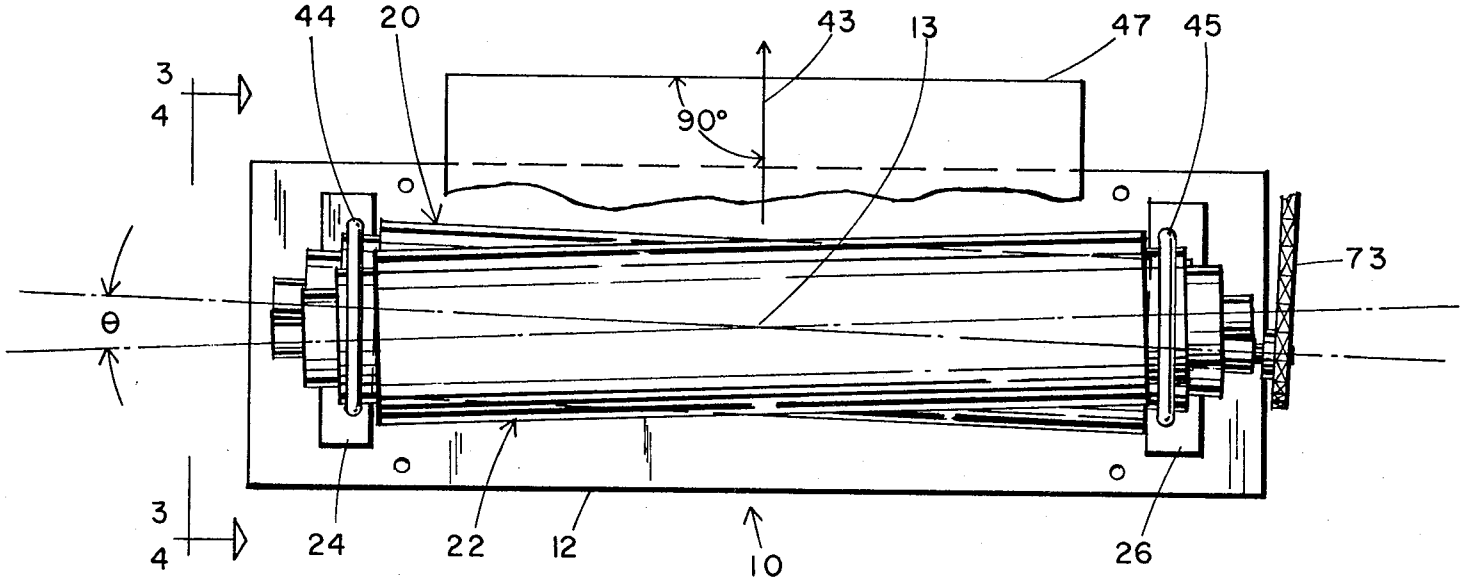
FIG. 1 is a top plan view of the preferred embodiment of a fixing apparatus with fixing rollers which cross at their respective midspan.
Figure 2:
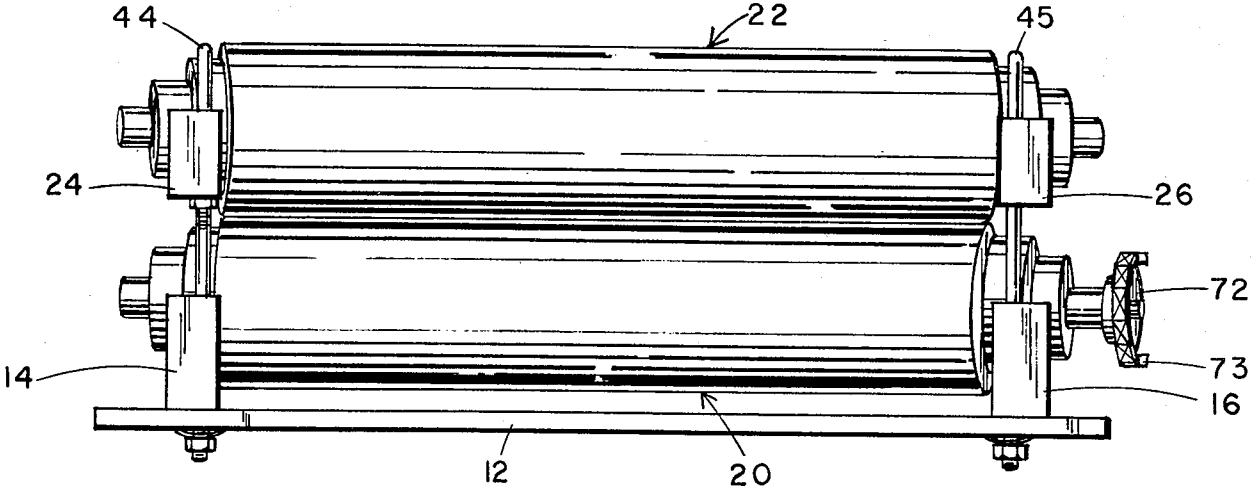
FIG. 2 is a front view of the apparatus shown in FIG. 1.
Figure 3:
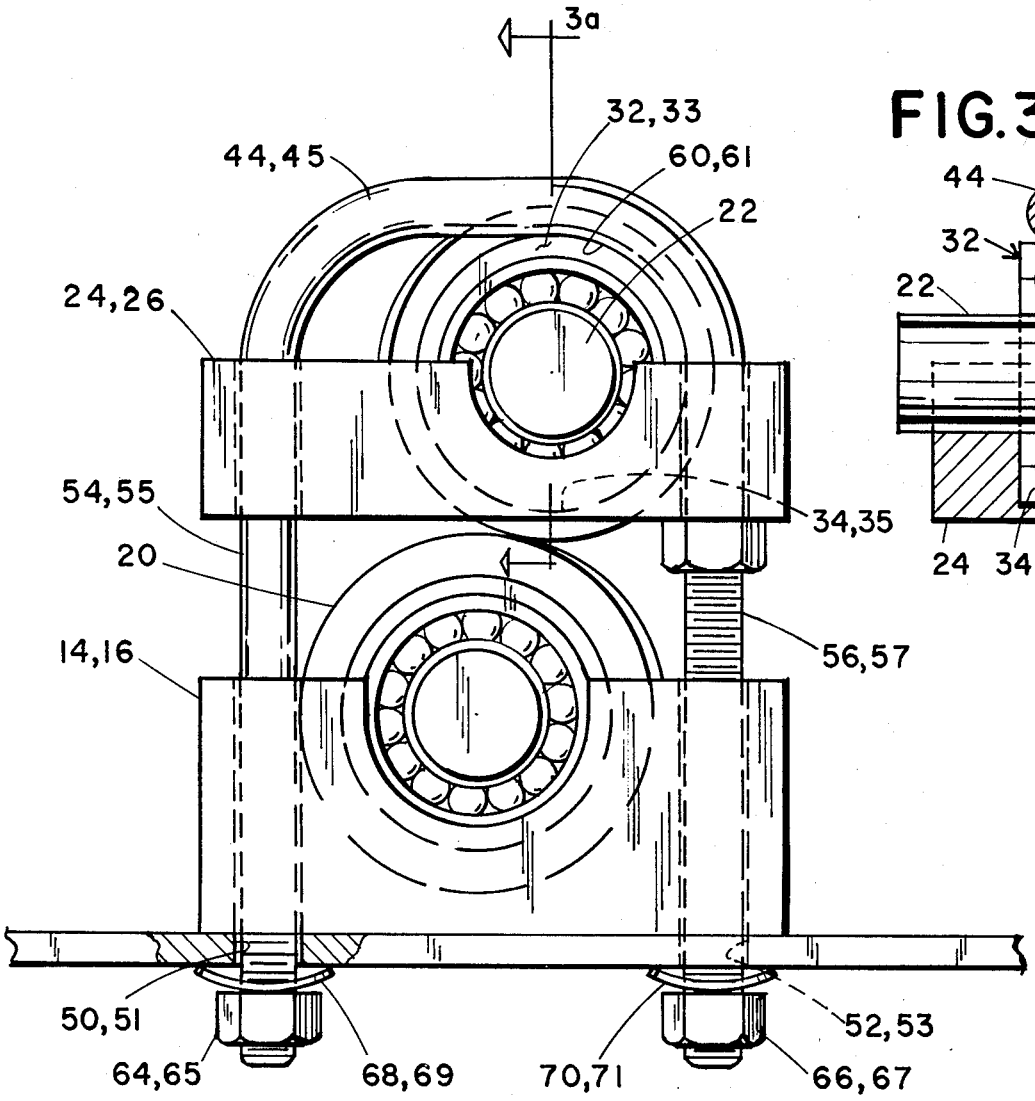
FIG. 3 is an end view of one embodiment of the apparatus shown in FIG. 1, which illustrates the "U" Bolt construction and accompanying support and hardware.
Figure 3A:
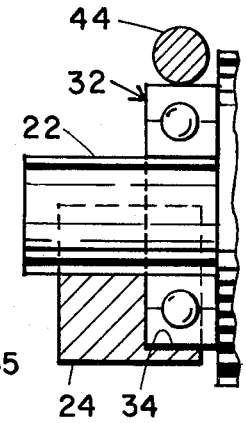
FIG. 3*a* is a partial section view taken from FIG. 3, showing part of the holding means for the upper roll bearing.

Referring to FIG. 1, there is illustrated a cold pressure fixing apparatus 10 in a plan view. The fixing apparatus 10 is comprised of a support means in the form of a structural base 12 and accompanying spaced apart lower end blocks 14 and 16, (FIG. 2), which form half journals to hold bearings for each respective end of the lower pressure roller 20 (FIGS. 2 and 3).

Within FIG. 3, the end view of the apparatus as taken from FIG. 1 illustrates the details for the clamping "U" Bolt construction which are described in the following specification.

There is an upper pair of spaced apart under end blocks 24 and 26 which serve to locate and rotatably support the bearings 32 and 33 for the ends of the upper pressure roller 22. There is a roller cross angle $\theta$, (FIG. 1) which is included and designed into the physical constraints of the fixing unit in order to provide means for creating a uniform lineal pressure across the span of the rollers 20 and 22. This angle typically ranges between 0.7° and 1.2°, depending upon the amount of pressure desired.

The angle $\theta$ is arranged to be symmetrical with respect to the center 13 (FIG. 1) of the fixing rollers 20 and 22. And, the point 13 where rollers 20 and 22 cross is intended to be at the center line path 43 of the typical copy paper sheet 47 which passes between the rollers 20 and 22.

It is possible to increase or decrease the outer diameters of the rollers 20 and 22 in addition to designing the fixing unit 10 with an alternate predetermined cross angle $\theta$ in order to achieve other desired pressures. It is additionally possible to construct cold pressure fixing rollers from tubular shaped steel. Consideration need only be given to a substantial wall thickness capable of withstanding the resultant end to end restraining forces and compressive stresses associated with the substantial lineal pressures provided at the nip between the rollers.

The construction of the fixing unit 10 is such that the clamping "U" Bolts 44 and 45 are physically located by the holes 50, 51, 52 and 53 located within the support base 12. This provides a relatively easy means of locating and assembling all of the associated parts, and especially the "U" Bolts 44 and 45 since it is convenient to drop the straight shank portions 54, 55, 56 and 57 of the "U" Bolts 44 and 45 directly through the locating holes 50, 51, 52 and 53, (FIG. 3). At this time, it is possible to locate the curved portions 60 and 61 of the "U" Bolts 44 and 45 on the top portion of the upper pressure roller bearings 32 and 33 so that the bearings 32 and 33 seat against the lower portions of the bearing journals 34 and 35 within the upper end blocks 24 and 26 respectively.

The clamping force is produced by turning the pressure nuts 64, 65, 66 and 67 which bear against the wavy springs 68, 69, 70 and 71 until the desired nip pressure between the rollers 20 and 22 is achieved. It is necessary to rely on springs such as those illustrated by the wavy washers 68, 69, 70 and 71 because it is desirable to have the rollers 20 and 22 open slightly as the lead edge of a three or four thousandths thick piece of copy paper enters the roll nip for the fixing process. And, the springs are selected to have a relatively low rate, over the small range of deflection caused by a given sheet of copy paper in order to treat each sheet of copy paper uniformly over its length as it proceeds through the fixing unit.

In order to provide appropriate rotative power from an input power transmission, there is a sprocket 72 suitably attached to one end of the lower fuser roller 20, (FIG. 1). In turn, an appropriately driven chain member 73 is engaged with sprocket member 72, and the chain is attached to an appropriate input drive member of the copier, (not shown).

In an alternate embodiment shown in FIG. 4 and FIG. 5, much of the concentration remains the same except for the upper end blocks, which have been removed.

In addition, the clamping "U" Bolts 44 and 45 have been reshaped where the inner surface 75*a* and 75*b* of the Bolts 44 and 45 engage the ends of roller 22. In this particular case, the ball bearings 36 and 37 are positioned within the upper roller which is a tube having a bore 76 at each end for receiving the ball bearings 36 and 37. The roller 22 is supported by a shaft 78 which has an appropriate keyway 80 and key 81 to engage a slotted portion 82 of the clamping "U" Bolts 44 and 45. The Keyway 80 and Key 81 is designed to prevent rotation of the upper pressure roller support shaft 78.

While several embodiments of the invention have been illustrated and described within the present specification, it will be obvious to those skilled in the art that many changes may be made in the size, shape detail and general arrangement. Therefore, the following claims are intended to capture the spirit and scope of the present invention.

What is claimed is:

1. In an electrophotographic copying machine having instrumentalities for producing a toner image on a copy sheet, a device for fixing the toner image onto the copy sheet, said device comprising:

A. a support means,

B. a pair of spaced apart lower end blocks resting on said support means,

C. a lower pressure roller extending between said spaced apart lower end blocks, D. lower bearing means mounted on said lower pressure roller supported by said pair of lower end blocks for rotatably supporting said lower pressure roller, E. an upper pressure roller resting on said lower pressure roller, F. upper bearing means mounted on said upper pressure roller for rotatably supporting said upper pressure roller, and G. clamping means engaging said upper bearing means, said lower end blocks and said support means for pressing said upper and lower pressure rollers together under substantially high pressure and for mounting said device on said support means.

2. A device as set forth in claim 1 wherein said clamping means includes an upper pair of spaced apart end blocks having means for receiving said upper bearing means so as to maintain said upper bearing means in a desired location.

3. A device as set forth in claim 2 wherein said clamping means further includes a pair of substantially U-shaped bolts each of which has a top portion which engages with said upper bearing means and leg portions which pass through said upper end blocks, said lower end blocks and said support means, and means for securing said U-shaped bolts to said support means.

4. A device as set forth in claim 3 wherein said clamping means includes resilient means for permitting a limited amount of movement of said upper pressure roller away from said lower pressure roller in order to permit a copy sheet to pass therebetween.

5. A device as set forth in claim 4 wherein said resilient means comprises a spring washer on each leg of each U-shaped bolt interposed between the side of said support means opposite to the side on which said device is mounted and means for securing said U-shaped bolts to said support means.

* * * * *